United States Patent [19]

Bulman

[11] Patent Number: 4,941,390

[45] Date of Patent: Jul. 17, 1990

[54] LIQUID PROPELLANT GUN

[75] Inventor: Melvin J. Bulman, Shelburne, Vt.

[73] Assignee: General Electric Company, Burlington, Vt.

[21] Appl. No.: 178,254

[22] Filed: Aug. 7, 1980

[51] Int. Cl.[5] ..... F41F 1/04

[52] U.S. Cl. ..... 89/7; 102/440

[58] Field of Search ..... 89/7; 102/440, 439, 102/443

[56] References Cited

U.S. PATENT DOCUMENTS

| | | | |
|---|---|---|---|
| 3,138,990 | 6/1964 | Jukes et al. | 89/7 |
| 3,763,739 | 10/1973 | Tassie | 89/7 |
| 4,023,463 | 5/1977 | Tassie | 89/7 |
| 4,160,405 | 7/1979 | Ayler et al. | 89/7 |

FOREIGN PATENT DOCUMENTS

| | | | |
|---|---|---|---|
| 1501852 | 2/1978 | United Kingdom | 89/7 |
| 1501853 | 2/1978 | United Kingdom | 89/7 |

*Primary Examiner*—David H. Brown
*Attorney, Agent, or Firm*—Bailin L. Kuch

[57] ABSTRACT

A feature of this invention is the provision in an annular piston, annular control valve, liquid propellant gun, of a check valve to permit liquid propellant under relatively low pressure to flow from the supply system into the combustion chamber and to preclude the pulse of pressure generated in the combustion chamber from feeding back to the supply system. This valve allows propellant to be removed automatically from the pumping chamber in the event of a misfire.

Another feature of this invention is the provision in an annular piston, annular control valve, liquid propellant gun of a frangible stem which secures the projectile to the cartridge case. The stem breaks to release the projectile for travel down the gun bore when a predetermined level of combustion gas pressure has been developed in the combustion chamber.

8 Claims, 2 Drawing Sheets

FIG. 2
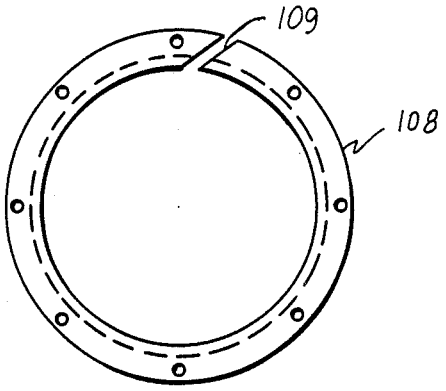
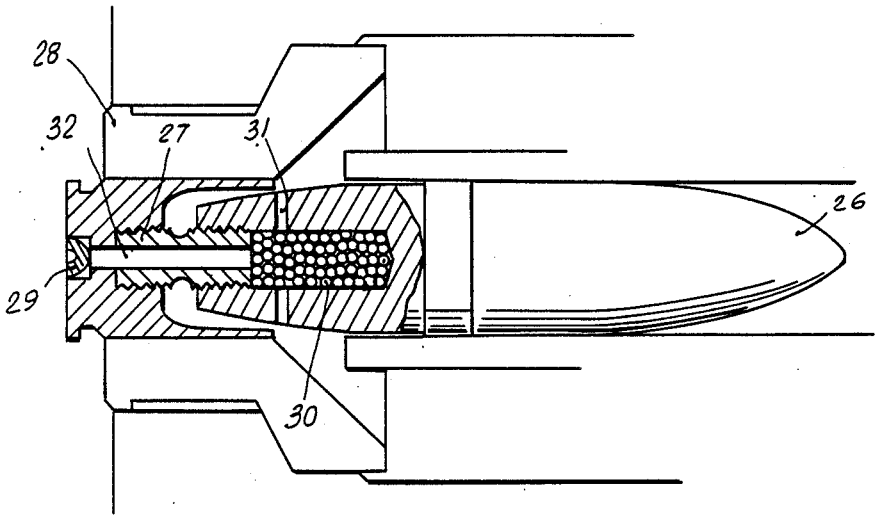
FIG. 3

LIQUID PROPELLANT GUN

BACKGROUND OF THE INVENTION

1. Field of the Invention

This invention relates to liquid propellant guns utilizing a differential piston to provide continued or regenerative injection of propellant into the combustion chamber.

2. Prior Art

This invention is an improvement of the invention disclosed in Ser. No. 840,074, filed Oct. 6, 1977 by M. Bulman. Ser. No. 840,074 discloses a liquid propellant gun system having an annular differential piston journaled for telescopic movement with respect to an annular control valve and to the chamber of the firing bore. Reference should be made to Ser. No. 840,074, hereby incorporated by reference, for structure not shown in this disclosure.

SUMMARY OF THE INVENTION

An object of this invention is to isolate the system for filling the combustion chamber with liquid propellant from the pulse of pressure generated in the combustion chamber upon the firing of the liquid propellant.

Another object of this invention is to allow automatic down loading of propellant in the event of a misfire.

Yet another object is to preclude movement of the projectile until a predetermined level of gas pressure has been developed in the combustion chamber.

Still another object of this invention is the provision of a compact valve that prevents leakage during fill while opening up to allow injection during firing.

A feature of this invention is the provision in an annular piston, annular control valve, liquid propellant gun, of a check valve to permit liquid propellant under relatively low pressure to flow from the supply system into the combustion chamber and to preclude the pulse of pressure generated in the combustion chamber from feeding back to the supply system.

Another feature of this invention is the provision in an annular piston, annular control valve, liquid propellant gun of a frangible stem which secures the projectile to the cartridge case. The stem breaks to release the projectile for travel down the gun bore when a predetermined level of combustion gas pressure has been developed in the combustion chamber.

BRIEF DESCRIPTION OF THE DRAWING

These and other features and advantages of the invention will be apparent from the following description of the invention taken in conjunction with the accompanying drawing in which:

FIG. 2 is a detail of a foot valve of the annular piston; and

FIG. 3 is a detail of a preferred version of the round of ammunition in the gun system of FIG. 1.

DESCRIPTION OF THE INVENTION

Figure 1:
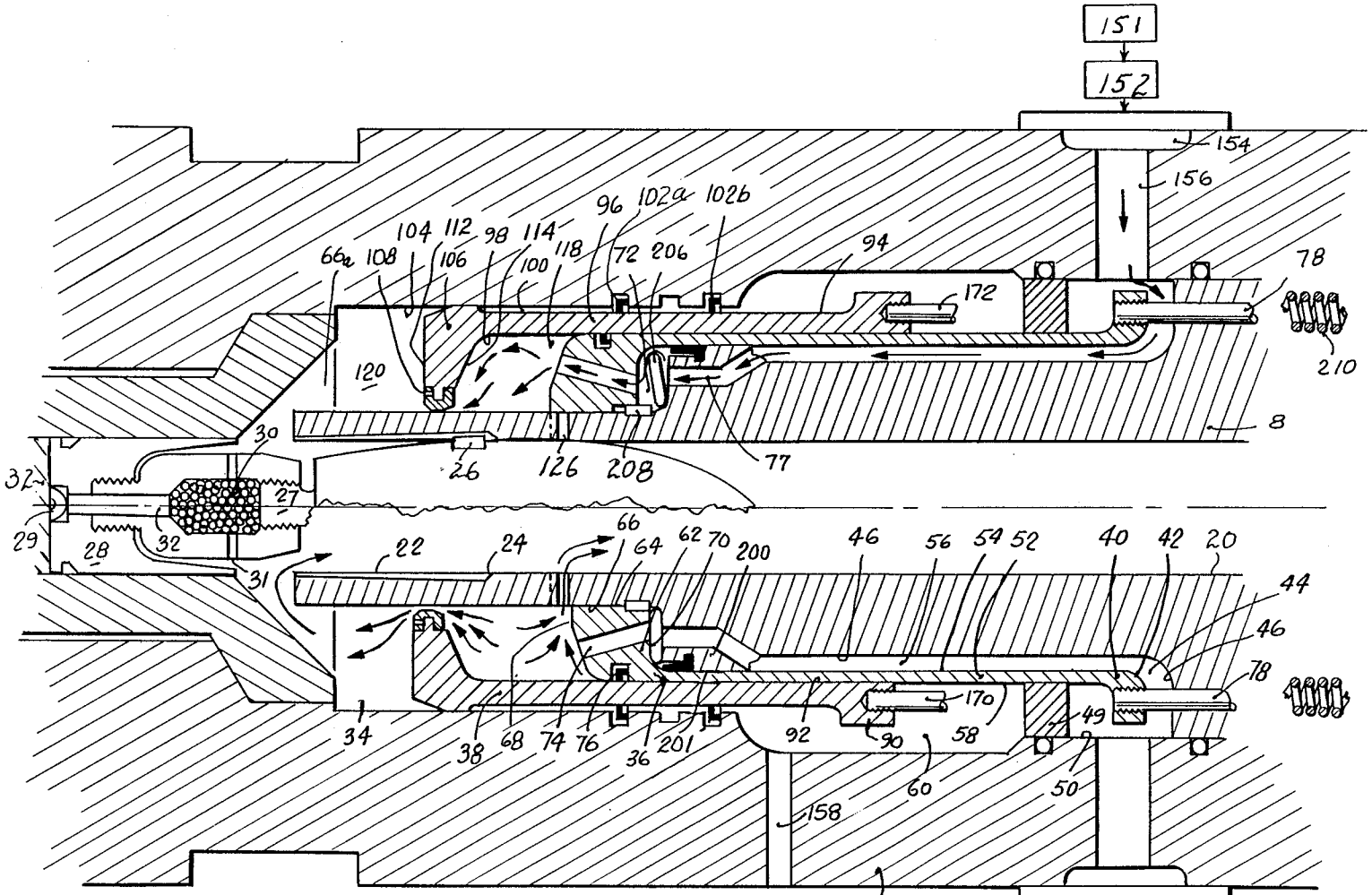
FIG.1 is a view in elevation, in longitudinal cross-section, of a gun system embodying this invention. The upper half of the view shows the assembly during the filling with liquid propellant, while the lower half shows the assembly after filling and during firing.

The gun system includes a gun barrel assembly 8 which is fixed within a housing 10. The barrel assembly has a rifled firing bore 20, a projectile receiving chamber 22 and an intermediate forcing cone 24. A round of ammunition comprising a projectile 25 with a band 26 is fixed by a frangible threaded tube 27 to a stub case 28 and has a percussion primer 29 and a booster charge 30. The round is chambered, locked and extracted by a conventional bolt 32, or, in a large caliber gun, a breech block. The projectile has a plurality of gas vents 31 for the booster charge, which is ignited by the primer via a bore 32.

The barrel assembly and the housing 10 define a substantially hollow cylindrical cavity 34 in which are telescopically disposed a substantially hollow cylindrical valve 36 and a substantially hollow cylindrical piston 38.

The valve 36 includes a forward annular portion 40 having an inner wall surface 42 providing an annular gap or passageway 44 adjacent the outer wall surface 46 of the barrel. The annular portion 40 is integral with an intermediate tubular portion 52 having an inner wall surface 54 providing an annular cavity 56 adjacent the outer wall surface 46, and an outer wall surface 58 providing an annular cavity 60 adjacent the inner wall surface 50 of the housing. The intermediate portion 52 is integral with an aft annular portion 62 having an inner wall surface 64 journaled on the outer wall surface 66 of the barrel and substantially sealed thereto, a transverse aft surface 68, a transverse forward surface 70, an inner annular cavity 72, a plurality of longitudinal bores or passageways 74 extending between the surfaces 68 and 70, and a ring seal 76 disposed in an annular groove in the outer wall surface 58. A plurality of longitudinal bores 77 provides passageways between the cavity 56 and the cavity 72 when the valve 36 is aft of its forwardmost position. Two rods 78 have their aft ends respectively fixed to the forward annular portion 40, and pass through bores in the housing. The rods are each biased aftwardly by a respective helical compression spring 210 captured between a cross pin on the rod and a plug in the housing. Each rod may have a respective seal as shown in Ser. No. 840,074.

The piston 38 includes a forward annular portion 90 having an inner wall surface 92 journaled on the surface 58 of the valve and an outer wall surface 94 spaced from the surface 50 of the housing. The annular portion 90 is integral with an intermediate tubular portion 96 having an inner surface 92 bearing against the ring seal 76 in the valve, and an outer surface 100 bearing against a pair of ring seals **102*a* and 102*b* respectively disposed in a pair of annular grooves in the inner surface 104 of the housing. The intermediate portion 96 is integral with an aft annular portion 106 having mounted thereon a U-shaped, ring type, foot valve 108 which is normally self biased to journal on and seal against the aftmost portion 66*a* of the outer surface 66 of the barrel. The valve 108 has a diagonal cut 109 therein, which permits the diameter of the ring to increase under internal counter-pressure. It will be seen that the effective cross-sectional area of the forward surface 114 of the aft annular portion 106 is less than the effective cross-sectional area of the aft surface 112, providing the piston sleeve 38** with a differential piston action.

The barrel 8, the valve 36 and the piston 38, depending on their mutual positioning, may be considered to define a liquid propellant fill cavity 56, a valve cavity 72, a pumping cavity 118, and a combustion cavity 120. The barrel 8 has a first plurality of radial passageways 126 and serves as passageway between the pumping chamber 118 and the bore 20.

A supply means 151 for supplying liquid propellant under pressure is coupled to a cam controlled valve 152 which is coupled to an inlet in the housing which leads to an annular passageway 154 in the housing, from which a plurality of radial bores 156 lead to and through the forward portion of the surface 50. A radial bore 158 leads through and from the surface 50 aft of the annulus 90 of the piston 38 to a vent.

Two rods 170 and 172 have their aft ends respectively fixed to the forward annular portion 90 of the piston 38, and pass through bores with seals in the housing. The forward ends of the rods respectively terminate in an enlargement. A drum cam, such as is shown in U.S. Pat. No. 3,763,739 filed June 1, 1971, by D. P. Tassie, has a helical control track in which rides a cam follower which has an arm which terminates in a rod follower. The rods are free to move forwardly free of the follower, but are controlled in their movement aftwardly by the cam track via the followers. The cam track is also able to pull the rods forwardly via the followers, all as shown in Ser. No. 840,074.

The barrel 8 has an enlarged portion 200 with an outer surface 201 which rides on and serves to seal against the inner surface 54 of the valve 36. A plurality of substantially longitudinal bores 77 are disposed in an annular row through the enlargement to serve as passageways from the fill annular cavity 56 to the valve cavity 72. The plurality of longitudinal bores 74 serve as passageways from the valve cavity 72 to the pumping cavity 118. When the pressure difference between the pumping cavity 118 and combustion chamber 120 exceeds the natural bias of the foot valve 108, it forces the valve 108 open to provide a gap between the outer surface 66 of the barrel and the valve which serves as a passageway from the pumping cavity 118 to the combustion chamber 120.

A belleville washer 206 is seated in the valve cavity 72 on the barrel adjacent the bores 77 and retained by a retaining ring 208. The washer is normally conical in shape and permits the flow of liquid propellant from the fill cavity 56, through the passageways 77, around the washer 206, through the valve cavity 72, and through the passageways 74 into the pumping cavity 118. Prior to firing, the differential valve 36 is held in the position shown in the upper portion of FIG. 1 by means of external compression springs 210 coupled to the rods 78, so that the surface 66 of the valve head 62 closes the radial bores 126 and precludes the flow of liquid propellant from the pumping cavity 118 into these bores. At the beginning of firing, the liquid pressure in the pumping cavity 118 will rise and be communicated to the valve cavity 72. This increase in pressure on the aft face of the washer 206 over the pressure on the forward face of washer will force the washer flat against its inherent spring force to close the passageways 77, to isolate the fill cavity 56 and its anterior system from the ballistic fluid pressures generated during the firing. During firing, because the forward face 70 of the valve head has less transverse area than the aft face 68, the differential pressure generated thereby will force the valve 36 forward, against the bias of the springs 210, to reduce the volume of the valve cavity 72 to substantially zero and to uncover the bores 126.

In the embodiment here shown, firing is initiated by a mechanical firing pin impacting the primer 29 to generate and pass hot gas under high pressure through the passageway 32 to the booster charge 30, which in turn generates hot gas under pressure which is passed through the vents 31 into the combustion cavity 120. This gas under pressure will act on the aft face 112 of the piston head 106 to force the piston forwardly, increasing the pressure in the pumping cavity 118 to open the foot valve 108 thereby providing an annular gap. Liquid propellant is forced from the pumping cavity 118 through this annular gap into the combustion cavity 120 and is ignited by the hot gas therein. Because the forward face 114 of the piston head has less transverse area than the aft face 112, the differential pressure generated will force the piston forwardly continuing the flow of liquid propellant through the annular gap. At a predetermined gas pressure in the combustion chamber, e.g., 5,000 psi, the frangible tube 27 will break and the projectile will be free to ride forwardly into the gun barrel bore to uncover the bores 126. Since the valve head 62 has already uncovered these bores, liquid propellant is now free to pass from the pumping cavity 118 through these bores into the aft end of the gun barrel bore to provide an annulus of liquid propellant in the gun barrel bore whose inner face is continually being ignited and whose outer face is being continually replenished.

In the event of a misfire, both the differential valve 36 and the belleville washer valve will remain in their initial, open dispositions, to permit the liquid propellant in the pumping cavity 118 to be returned to the supply system 151 by the process of moving the differential piston forwardly via the rods 170 and 172.

What is claimed is:

1. A liquid propellant gun comprising:

a housing having a longitudinally extending first cavity therein;

a gun barrel having a firing bore with a projectile receiving chamber disposed along a longitudinal axis;

said gun barrel being disposed within said housing first cavity and with said housing defining a second closed cavity which is a portion of said first cavity and is of substantially annular, longitudinally extending shape and is coaxial with said barrel longitudinal axis;

a valve sleeve of substantially annular, longitudinally extending shape coaxial with said barrel longitudinal axis and disposed in said second cavity;

a piston sleeve of substantially annular, longitudinally extending shape coaxial with said barrel longitudinal axis and disposed in said second cavity;

said piston sleeve and said valve sleeve being journaled for relative motion with respect to each other and said gun barrel, said piston sleeve and said valve sleeve mutually defining a pumping chamber of variable volume for liquid propellant;

obturating means for closing the aft end of said projectile receiving chamber;

supply means for supplying liquid propellant under pressure;

additional valve means;

first conduit means for coupling said supply means to said additional valve means; additional valve means to said pumping chamber;

third conduit means for coupling and decoupling said pumping chamber to said projectile receiving chamber;

said valve sleeve, said piston sleeve, said first conduit means, said second conduit means and said third conduit means having a mode of operation such that:

initially said first conduit means, said second conduit means and said third conduit means are each decoupled and said pumping chamber is at its minimum volume, claim 1 (continued)

subsequently said first conduit means is coupled and passes liquid propellant to said additional valve means, subsequently said second conduit means is coupled and passes liquid propellant to said pumping chamber, subsequently said pumping chamber is expanded to its maximum volume by inletted liquid propellant, and subsequently said pumping chamber is reduced in volume by high pressure combustion, and said third conduit means is coupled, injecting liquid propellant into said projectile receiving chamber, and said additional valve means is for permitting liquid propellant under relatively low pressure to flow from said supply means to said pumping chamber and for precluding the pulse of pressure generated upon firing in the combustion chamber from passing to said supply means.

2. A gun according to claim 1 further including:

control means coupled to said piston sleeve and having a mode of operation such that it will displace said piston sleeve to reduce said volume of said pumping chamber in the event said volume is not reduced by combustion pressure, to cause the extraction of unfired liquid propellant through said additional valve means.

3. A liquid propellant gun comprising:

a housing, a gun barrel, a differential annular valve, a differential annular piston, said housing, barrel, valve and piston defining a fill chamber, a pumping chamber and a combustion chamber, and first means for permitting liquid propellant under relatively low pressure to flow from said fill chamber into said pumping chamber and then into said combustion chamber, and for precluding the pulse of pressure generated upon firing in said combustion chamber from passing into said fill chamber.

4. A liquid propellant gun comprising:

a housing having a longitudinally extending first cavity therein;

a gun barrel having a firing bore with a projectile receiving chamber disposed along a longitudinal axis;

said gun barrel being disposed within said housing first cavity and with said housing defining a second closed cavity which is a portion of said first cavity and is of substantially annular, longitudinally extending shape and is coaxial with said barrel longitudinal axis;

a valve sleeve of substantially annular, longitudinally extending shape coaxial with said barrel longitudinal axis and disposed in said second cavity;

a piston sleeve of substantially annular, longitudinally extending shape coaxial with said barrel longitudinal axis and disposed in said second cavity;

said piston sleeve and said valve sleeve being journaled for relative motion with respect to each other and said gun barrel, said piston sleeve and said valve sleeve mutually defining a pumping chamber of variable volume for liquid propellant;

obturating means for closing the aft end of said projectile receiving chamber;

supply means for supplying liquid propellant under pressure; and additional valve means when under relatively low pressure for precluding the flow of liquid propellant from said pumping chamber into said combustion chamber and when under relatively higher pressure for permitting the flow of liquid propellant from said pumping chamber into said combustion chamber.

5. A liquid propellant gun comprising:

a housing, a gun barrel, a differential annular valve, a differential annular piston, said housing, barrel, valve and piston defining a fill chamber, a pumping chamber and a combustion chamber, and valve means when under relatively low pressure for precluding the flow of liquid propellant from said pumping chamber into said combustion chamber and when under relatively higher pressure for permitting the flow of liquid propellant from said pumping chamber into said combustion chamber.

6. A gun according to claim 5 wherein:

said valve means comprises an annular seal means which seals said annular valve to said annular piston at relatively low pressure and claim 6 (continued) which opens at relatively higher pressure to provide an annular gap between said annular valve and said annular piston.

7. A liquid propellant gun comprising:

a housing, a gun barrel having a chamber, a differential piston, said housing, barrel and piston defining a combustion chamber, an obturator for said chamber, a round of ammunition disposed in said chamber comprising:

a cartridge case, a projectile, a rupturable element interconnecting said case and said projectile, a primer disposed in the base of said case, a booster disposed in said projectile, a first passageway extending through said element and interconnecting said primer and said booster.

a second passageway in said projectile communicating said booster charge with the exterior of said projectile, said exterior of said projectile being in communication with said combustion chamber.

8. A liquid propellant gun comprising:

a housing, a gun barrel a differential annular valve a differential annular piston, said housing, barrel, valve and piston defining a fill chamber, a pumping chamber and a combustion chamber, and first means for permitting liquid propellant under relatively low pressure to flow from said fill chamber into said pumping chamber and then into said combustion chamber, and for precluding the pulse of pressure generated upon firing in said combustion chamber from passing into said fill chamber;

said first means comprising:

an opening, communicating between said fill chamber and said supply chamber, a belleville washer disposed adjacent said opening and normally disposed with its outer peripheral portion spaced from said opening, said outer peripheral portion adapted to deflect, under pressure, against and to close said opening.

* * * * *